US006123023A

United States Patent [19]

Ono

[11] Patent Number: 6,123,023

[45] Date of Patent: Sep. 26, 2000

[54] STENCIL PRINTING METHOD AND APPARATUS

[75] Inventor: Ryuta Ono, Inashiki-gun, Japan

[73] Assignee: Riso Kagaku Corporation, Tokyo, Japan

[21] Appl. No.: 09/157,400

[22] Filed: Sep. 21, 1998

[30] Foreign Application Priority Data

Sep. 22, 1997 [JP] Japan ..... 9-275026

[51] Int. Cl.[7] ..... B41F 15/40

[52] U.S. Cl. ..... 101/129; 101/125; 101/127.1; 101/128.21

[58] Field of Search ..... 101/114, 125, 101/127, 127.1, 128.1, 128.21, 128.4, 129

[56] References Cited

U.S. PATENT DOCUMENTS

| | | | |
|---|---|---|---|
| 3,445,310 | 5/1969 | Danielson et al. | 101/129 |
| 3,460,471 | 8/1969 | Green et al. | 10/129 |
| 3,527,163 | 9/1970 | Bean | 101/129 |
| 4,142,464 | 3/1979 | Rauch | 101/128.21 |
| 4,409,893 | 10/1983 | Newman et al. | 101/129 |
| 4,958,560 | 9/1990 | Collins | 101/128.21 |
| 5,355,793 | 10/1994 | Sato et al. | 101/128.21 |
| 5,450,789 | 9/1995 | Hasegawa | 101/128.21 |
| 5,638,750 | 6/1997 | Sato | 101/127.1 |

FOREIGN PATENT DOCUMENTS 0 446 839 9/1991 European Pat. Off. .

OTHER PUBLICATIONS

Patent Abstracts of Japan vol. 010, No. 163 (M–487), Jun. 11, 1986 & JP 61 014978 A (Pilot Pen KK), Jan. 23, 1986.
Patent Abstracts of Japan vol. 010, No. 118 (M–475), May 2, 1986 & JP 60 247587 A (Risou Kagaku Kogyo KK), Dec. 7, 1985.

*Primary Examiner*—Stephen R. Funk
*Attorney, Agent, or Firm*—Pillsbury Madison & Sutro LLP

[57] ABSTRACT

The disclosed stencil printing method can produce prints having high glossiness by inhibiting the uneven transfer of ink caused by operation of separation of stencil. A stencil printing apparatus is disclosed. The stencil printing method includes superposing one upon another a master stencil sheet (3) and a printing material (1) (a material to be printed) and pressing an ink supply element (2) to the master stencil sheet from the side opposite to the printing material, in the direction toward the printing material, thereby passing a printing ink through the master stencil sheet to transfer the ink to the printing material, wherein ink-passing porous member (4) is disposed between the ink supply element and the printing material to transfer the printing ink to the printing material through the porous member. The ink supply element is separated from the porous member while the porous member is left on the printing material, and then the porous member is separated from the printing material. The porous member may be disposed between the ink supply element and the master stencil sheet or between the master stencil sheet and the printing material. The master stencil sheet and the porous member or the ink supply element may be bonded to each other.

9 Claims, 6 Drawing Sheets

STENCIL PRINTING METHOD AND APPARATUS

BACKGROUND OF THE INVENTION

The present invention relates to a stencil printing method suitable for obtaining prints on which the ink is smoothly and thickly applied and to an apparatus used for carrying out the method.

Stencil printing is utilized in various fields because of its easy preparation of master stencil sheets. However, according to the stencil printing, a printing ink is applied onto the outer surface of the master stencil sheet superposed on a material to be printed (hereinafter referred to as "printing material") and the printing ink is forced out through perforations of the stencil sheet by an ink supply means such as a pressing plate or a roller to transfer the ink onto the printing material, and thereafter the stencil sheet and the printing material are separated. Therefore, the amount of the printing ink transferred is great, and it is especially difficult to transfer the printing ink at a uniform thickness without causing uneven transfer.

Particularly, uneven transfer of the printing ink is conspicuous in the solid print portion, whereby appearance of printed images is apt to be damaged. This uneven transfer can be improved by using printing materials high in permeability to the printing ink. However, when coated papers, plastics and glass sheets, which are low in permeability to the printing ink and high in smoothness, are used, such improvement cannot be expected. Moreover, if an ink high in fluidity is used, printing high in smoothness is possible thanks to self-leveling of the ink, but it becomes difficult to retain the ink in stencil sheets or to obtain prints onto which the ink is thickly applied.

Causes for such uneven transfer as mentioned above are considered to be as follows. That is, since the ink per se has viscosity, when the stencil sheet and the printing material are separated, an internal stress is generated between the ink on the side of the stencil sheet and the ink transferred to the printing material, and these inks string with each other to cause the ink to finally be cut in pieces irregularly.

For reducing the uneven transfer, Japanese Patent Laid-open (Kokai) No. 61-14978 proposes to make constant a time in which a master stencil sheet is pressed to a printing material to transfer an ink to the material. However, according to this method, unevenness in the amount of the transferred printing ink, which is caused by a difference in the pressing time, can be diminished, but the unevenness on a surface of the transferred printing ink, which is caused by stringiness of the printing ink at the time of separation of the master stencil sheet, cannot be diminished.

SUMMARY OF THE INVENTION

The object of the present invention is to provide a stencil printing method suitable for obtaining prints on which ink is smoothly and thickly applied and to a stencil printing apparatus therefor.

According to the present invention, the above object has been attained by a stencil printing method comprising a step of pressing together an ink supply means and a printing material to be printed while a master stencil sheet and an ink-passing porous member are interposed between said ink supply means and said printing material, whereby an ink is transferred from said ink supply means to said printing material in accordance with an image of said master stencil sheet, a step of separating said ink supply means from said porous member while said porous member is left on said printing material, and a step of separating said porous member from said printing material.

That is, the present invention relates to a stencil printing method in which when a master stencil sheet and a printing material are superposed one upon another and an ink supply means is pressed to an outer surface of the master stencil sheet to allow a printing ink to reach the printing material from the ink supply means through perforations of the master stencil sheet, an ink-passing porous member is provided in a route through which the printing ink reaches the printing material from the ink supply means so that the printing ink is transferred to the printing material through the porous member, and, furthermore, after the printing ink is transferred to the printing material in this way, the ink supply means is removed from the porous member while the porous member is kept on the side of the printing material and thereafter the porous member is separated from the printing material.

In the present invention, after the printing ink is transferred to the printing material, the ink supply means is first removed from the porous member. Therefore, at this point of time, the printing ink which is impregnated in the porous member and transferred to the printing material is kept under atmospheric pressure, and the transferred ink is adjusted to a uniform thickness in accordance with a thickness of the porous member. Thereafter, when the porous member is separated from the printing material, the printing ink is not exposed to an abrupt change of pressure so as not to generate an internal stress in the ink and in this state the ink retained in the porous member is transferred to the printing material. Thus, unevenness of the surface of the printing ink hardly occurs and uneven transfer can be reduced to the minimum. When the porous member is separated from the printing material, the transfer of the ink to the printing material may be aided by application of wind pressure to an extent that does not affect the image.

DESCRIPTION OF THE INVENTION

In the present invention, as the porous member, there may be used, for example, a gauze made of fibers such as of polyester, nylon, rayon, stainless steel, silk, cotton and metal, and, besides, Japanese paper, woven fabric, non-woven fabric, sponge and open-cell foamed sheet. Preferred are those which do not diffuse the printing ink. Conveniently, a sheet-like porous member can be obtained by subjecting a known stencil sheet comprising a thermoplastic film laminated on an ink-passing porous support to overall solid perforation in which the thermoplastic film is entirely perforated so as to expose substantially all the surfaces of the porous support. It is desired that the material, size and structure of the porous member are optionally selected considering thickness of the printing ink to be printed on the printing material, passing property of ink and wettability of ink.

As mentioned above, in the present invention, the porous member may be provided at any position in the route through which the printing ink is transferred to the printing material from the ink supply means at the time of printing. Specifically, it can be provided between the ink supply means and the master stencil sheet or between the master stencil sheet and the printing material. Furthermore the master stencil sheet and the porous member may be integrated into one sheet which can be made porous at portions through which an ink is to be passed to print an image on a printing material.

In the present invention, the master stencil sheet can be produced by perforating a known stencil sheet by heat sensitive perforation method or by perforating an ink-impermeable sheet by photosensitive perforation method, drawing method or cutting method. The master stencil sheet may be separate from the porous member or may be integratedly laminated on one of the surfaces of the porous member. In the latter case, a master stencil sheet laminated on the porous member can readily be obtained by perforating a known stencil sheet comprising a thermoplastic film laminated on an ink-permeable porous support in conformity with a desired image.

In the present invention, any ink supply means can be used as far as they can be inked and used for pressing out the printing ink to the printing material through perforations of the master stencil sheet and the porous member to transfer the ink to the printing material. For example, mention may be made of a pad, sponge and roller impregnated or coated with a printing ink. Conveniently, the ink supply means can be constructed by subjecting to overall solid perforation a known stencil sheet comprising a thermoplastic film laminated on an ink-passing porous support, and then supporting it on a pressing plate with a printing ink between the stencil sheet and the pressing plate. Furthermore, in the case of the stencil sheet being perforated in accordance with the desired print image, the perforated stencil sheet may be inked to act as, as a whole, not only the ink supply means but also the master stencil sheet.

The printing ink usable in the present invention has no special limitation, and oil ink, water ink, emulsion ink and the like can be used. However, in case wettability of the ink to the porous member is higher than that of the ink to the printing material, transfer of the printing ink to the printing material from the porous member sometimes becomes non-uniform, and hence it is preferred to use an ink which is higher in wettability to the printing material than that to the porous member.

The stencil printing method of the present invention can be performed not only by a pressing type portable stencil printing apparatus commercially available under a product name of PRINT GOCCO (registered trademark: manufactured by RISO KAGAKU CORPORATION), but also by rotary stencil printing apparatuses.

The stencil printing method of the present invention can be performed by, for example, a stencil printing apparatus comprising a first member supporting a printing material, a second member arranged opposing the first member so as to be able to press the printing material and holding an ink supply means and a master stencil sheet laminated in succession on the surface opposing the printing material, and a third member holding a porous member between the first member and the second member.

The stencil printing method of the present invention can also be performed by a stencil printing apparatus comprising a first member supporting a printing material, a second member arranged opposing the first member so as to be able to press the printing material and holding an ink supply means on the surface opposing the printing material, and a third member holding a master stencil sheet and a porous member laminated in succession between the first member and the second member.

DETAILED DESCRIPTION OF THE PREFERRED EMBODIMENT

Figure 1A:
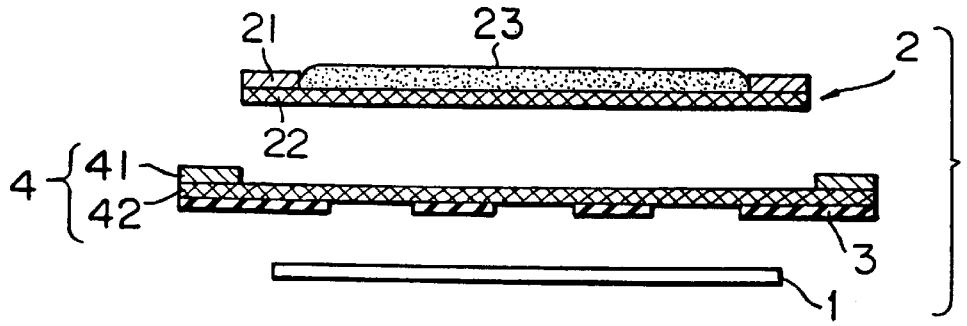
FIGS. 1(*a*)–(*d*) are sectional views which show one example of the stencil printing method of the present invention.
Figure 1B:
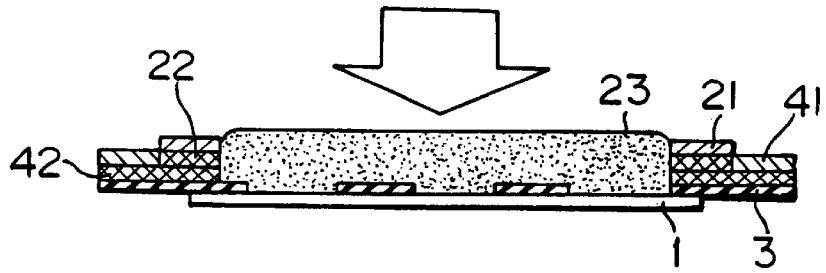
Figure 1C:
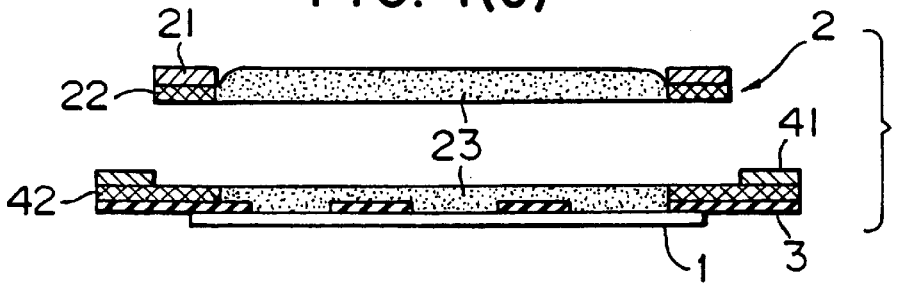
Figure 1D:
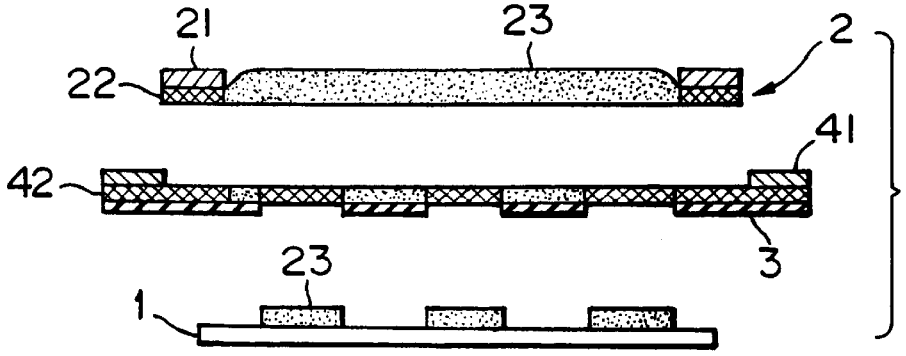

An example of the present invention will be explained in more detail referring to the above drawings.

In FIG. 1, the reference numeral 1 indicates a printing material, i.e., a material to be printed, 2 indicates an ink supply means, 3 indicates a master stencil sheet, and 4 indicates a porous member.

The ink supply means 2 is constructed by stretching an ink-passing gauze 22 on a frame 21 and placing a printing ink 23 on one surface of the gauze 22. This ink supply means 2 can be obtained, for example, from a known stencil sheet unit comprising a frame of cardboard or plastics on which is extended a stencil sheet composed of a thermoplastic resin film laminated on an ink-passing porous support by subjecting it to overall solid perforation so as to totally remove the thermoplastic resin film. Such a stencil sheet unit may have substantially the same structure as disclosed in Japanese Utility Model Laid-open (Kokai) No.51-132007 and regarding the detail thereof, the publication should be referred to. The stencil sheet unit may have an ink cover sheet (not shown) which is fixed at an end to the stencil sheet unit on a side on which the ink is placed, in such a manner that it can be opened and closed.

The porous member 4 comprises an ink-passing gauze 42 stretched on a frame 41. The example of FIG. 1 shows an embodiment where the master stencil sheet 3 is provided between the printing material 1 and the porous member 4. Furthermore, in the example of FIG. 1, the master stencil sheet 3 is bonded to the porous member 4. Such a bonded assembly consisting of the master stencil sheet 3 and the porous member 4 can be produced by perforating a stencil sheet of the above-mentioned stencil sheet unit by a usual perforating method using a flash lamp or a thermal head to obtain perforations in conformity with a desired image.

For carrying out a printing by the stencil printing method of the present invention, first the master stencil sheet 3 and the porous member 4 are provided above the printing material 1 and besides the ink supply means 2 is provided above the porous member 4 with the ink-placed side facing upward as shown in FIG. 1(*a*). Then, as shown in FIG. 1(*b*), the printing material 1, the master stencil sheet 3, the porous member 4 and the ink supply means 2 are brought into close contact with each other, and a pressing force is applied in the direction shown by the arrow in the FIG. 1(*b*) to press out the printing ink 23, whereby the printing ink 23 is passed through the gauze 22 and the gauze 42 and through the perforations of the master stencil sheet 3 and transferred onto the printing material 1. Thereafter, as shown in FIG. 1(*c*), with the printing material 1, the master stencil sheet 3 and the porous member 4 being maintained in layers, only the ink supply means 2 is separated from the porous member 4. In this instance, the printing ink 23 transferred to the printing material through the gauze 42 is kept at a uniform thickness and the surface thereof is again under atmospheric pressure. Therefore, when the porous member 4 together with the master stencil sheet 3 are separated from the printing material 1 as shown in FIG. 1(*d*), the surface of the printing ink 23 is not subjected to abrupt change of pressure, and, as a result, formation of irregularity on the surface caused by viscosity or stringiness of the ink is inhibited and the ink held in the porous member is transferred to the printing material to form a print surface high in smoothness. The ink is supplied also to non-image portions of the porous member, and thus in the case of printing of many copies, care should be taken so that the ink is inhibited from being supplied excessively to the porous member and overflowing therefrom, for example, by adjusting the ink supplied from the ink supply means to an amount that compensates for the transferred ink. When ink is supplied so that thickness of the ink is greater than that of the porous member, there may be generated an internal stress between the ink on the porous member and the ink in the porous member, which sometimes causes uneven transfer when the porous substrate is removed. Therefore, it is preferred to supply the ink so as to be equal to or smaller than the thickness of the porous member.

Figure 2A:
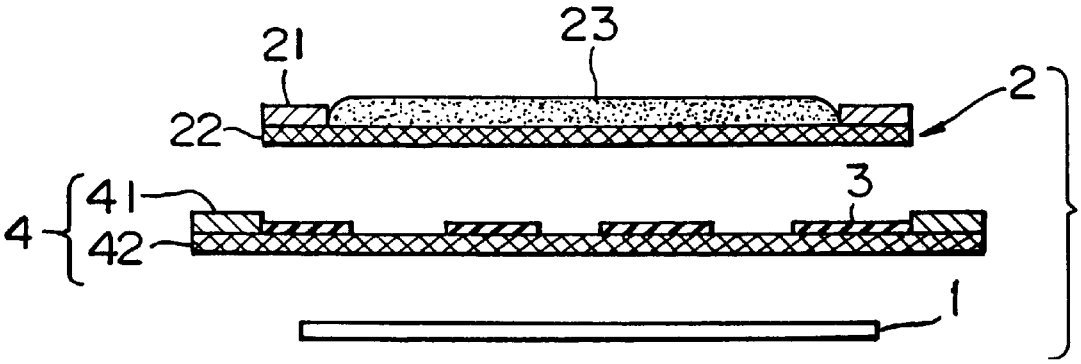
FIGS. 2(*a*)–(*c*) are sectional views which show a modification example of FIG. 1.
Figure 2B:
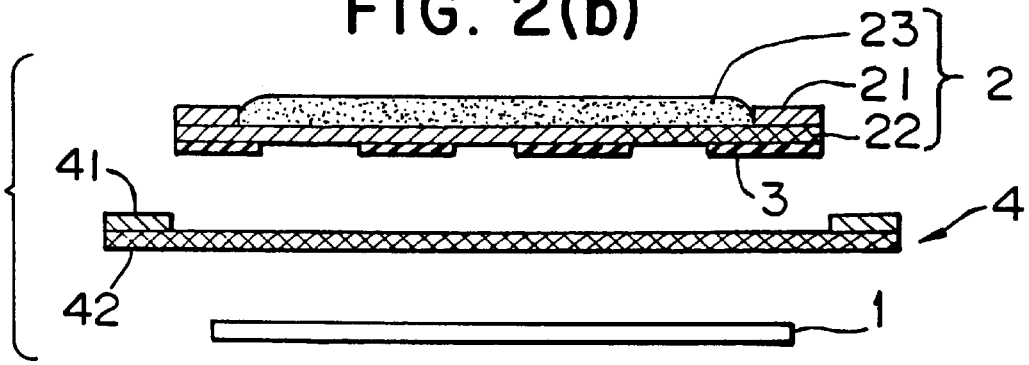
Figure 2C:
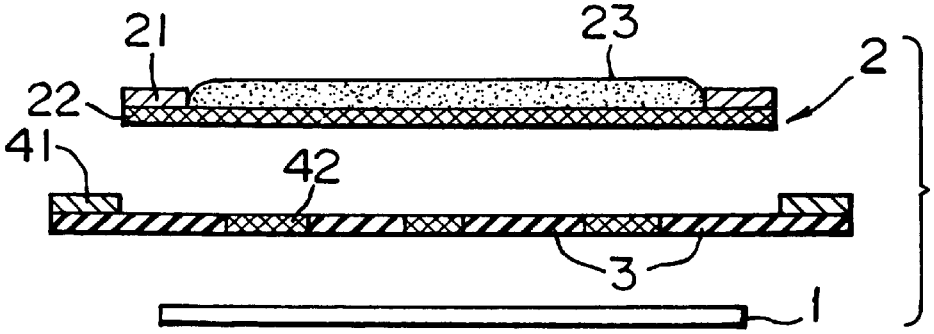

The present invention is not limited to only the embodiment of FIG. 1(*c*) in which the master stencil sheet 3 is provided between the printing material 1 and the porous member 4 as far as the ink supply means 2 can be separated while the porous member 4 is left on the side of the printing material 1 after the printing ink 23 has been transferred to the printing material 1. That is, the master stencil sheet 3 may be provided between the porous member 4 and the ink supply means 2 as shown in FIGS. 2(*a*) and 2(*b*). In the arrangement of FIG. 2(*a*), the master stencil sheet 3 is bonded to the porous member 4 as a unit. In the arrangement of FIG. 2(*b*), the master stencil sheet 3 is bonded to the gauze 22 of the ink supply means 2 as a unit. Such units comprising the master stencil sheet 3 and the porous member 4 or the ink supply means 2 can be easily produced by perforating a stencil sheet of the abovementioned stencil sheet unit with a usual perforation method using a flash lamp or a thermal head to obtain perforations in conformity with the desired images. Moreover, as shown in FIG. 2(*c*), the master stencil sheet 3 may be arranged coplanar with the porous member, and, in other words, may be composed of a porous member impregnated with a photosensitive resin, which can yield a stencil by exposing the resin to a light through a mask of a positive film. However, in the embodiments of FIGS. 2(*a*) and 2(*b*), owing to spread of the ink in the porous member, the images printed on the printing material 1 are apt to blur, and, on the other hand, the embodiment of FIG. 2(*c*) requires much labor in perforation. Therefore, it is preferred to carry out the present invention according to the embodiment illustrated in FIG. 1.

Hereinafter, an example of the stencil printing apparatus of the present invention will be explained referring to FIG. 3 to FIG. 7.

Figure 3:
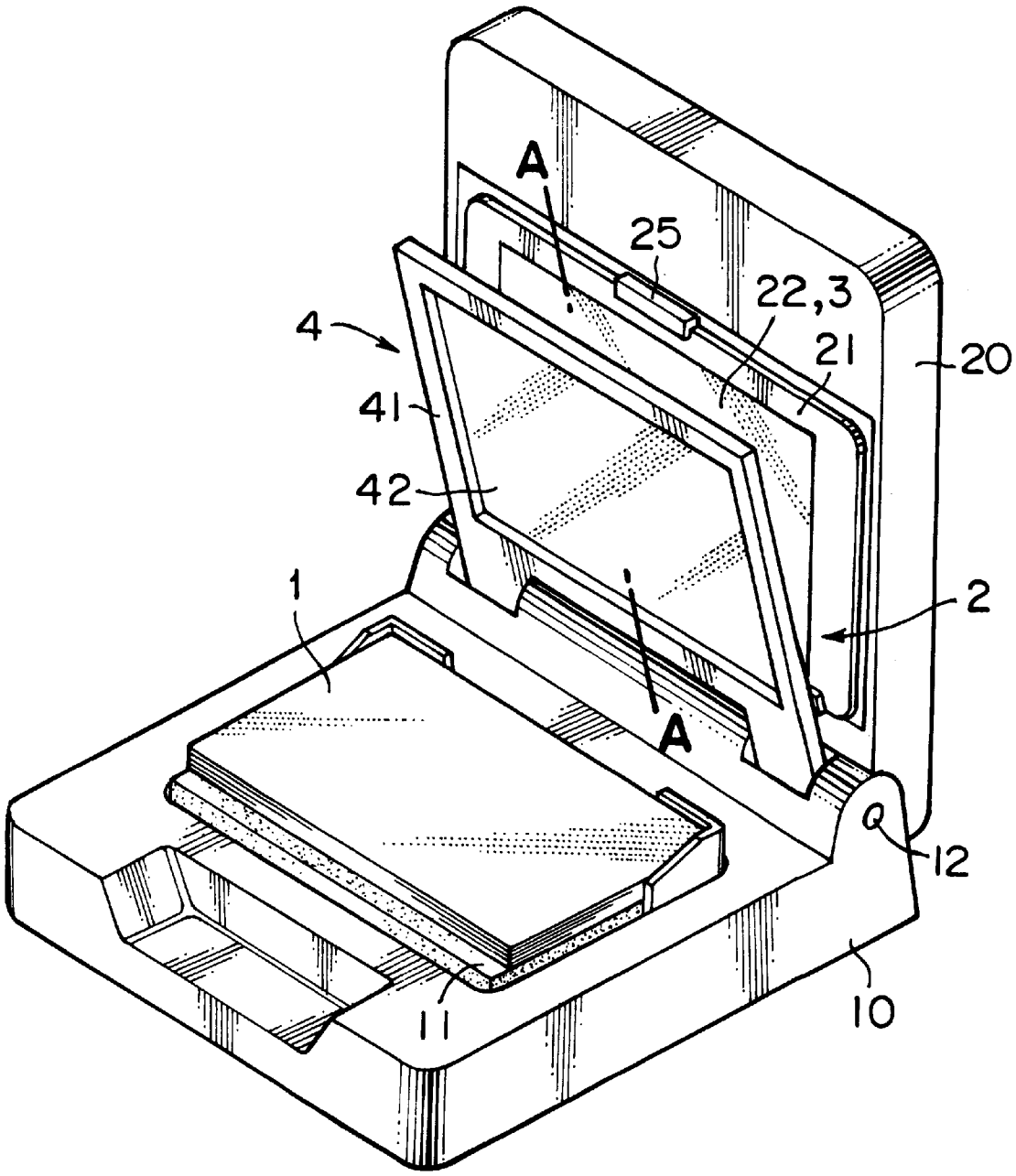
FIG. 3 is an oblique view which shows one example of the stencil printing apparatus of the present invention.

FIG. 3 is an oblique view which illustrates the whole of an example of the printing apparatus according to the present invention. This printing apparatus has a base stand 10 as a first member supporting a printing material 1 and a pressing plate 20 fitted, rotatably at one end, to a shaft 12 provided at one edge side of the base stand 10. The pressing plate 20 acts as a second member supporting an ink supply means. The base stand 10 has a paper stacking stand 11 on the upper surface. The paper stacking stand 11 has a cushioning member, on which several sheets of printing paper can be stacked as the printing material 1. At the time of printing, a pressing force is applied to the printing papers on the paper stacking stand 11 by the pressing plate 20, and the cushioning member is elastically compressed by the pressing force.

In FIG. 3, the pressing plate 20 is apart from the base stand 10, and the pressing plate 20 and the base stand 10 are parted from each other at an angle of about 90° in respect to the revolving shaft 12. A fitting part 25 is provided on the lower surface of the pressing plate 20 and a frame of a known stencil sheet unit mentioned above can be removably fitted and held thereby. This example is such that can carry out printing according to the arrangement of FIG. 2(*b*).

Therefore, to the fitting part 25 is fitted a known stencil sheet unit perforated in conformity with a desired image. The stencil sheet unit can comprise a nearly rectangular frame 21 on one side of which is stretched a stencil sheet comprising a thermoplastic resin film laminated with a gauze 22 and to another side of which is fitted an ink-impermeable cover sheet (not shown) which can be opened or closed with respect to the frame 21. After the stencil sheet is perforated in conformity with the desired image, the ink-impermeable sheet is opened, then a printing ink 23 is charged inside the frame 21, and the ink-impermeable sheet is again closed to enclose the printing ink 23 in the frame 21. The stencil sheet unit containing the printing ink is fitted to the fitting part 25 of the pressing pate 20 and the printing is carried out.

In FIG. 3, a porous member 4 is disposed between the base stand 10 and the pressing plate 20. The porous member 4 comprises a frame 41 as a third member of the present invention and a gauze 42 stretched on the frame 41 and held thereby. The frame 41 is removably fitted to the revolving shaft 12 of the pressing plate 20. The frame 41 comprises a material of high rigidity, such as a cardboard, a metal or a plastic. When the gauze 42 is held thereby under application of tension, separation from the printing material can be uniformly performed at the time of printing and this is preferred. Moreover, the gauze 42 may be removably held by the frame 41 so that exchanging or cleaning of the gauze can be easily performed.

Figure 4A:
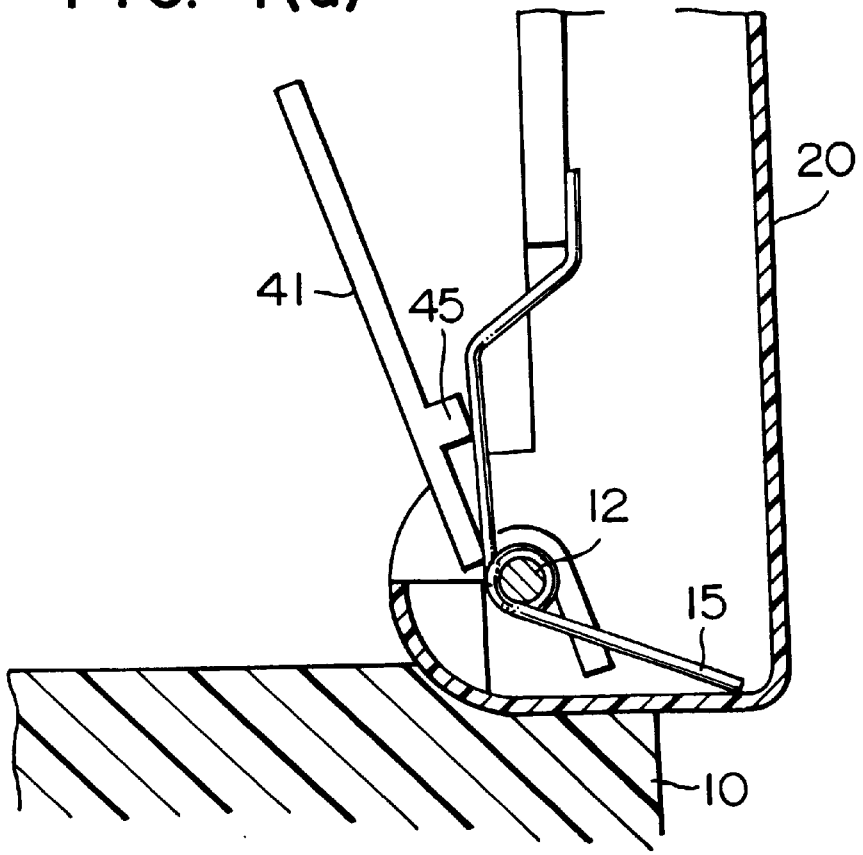
FIGS. 4(*a*)–(*d*) is a partly enlarged sectional view of the stencil printing apparatus shown in FIG. 3, taken along line A—A of FIG. 3.
Figure 4B:
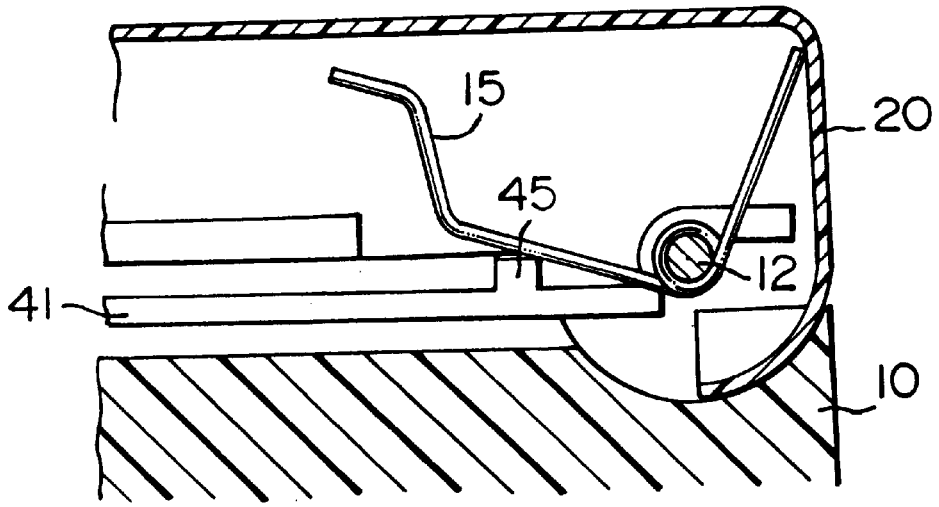

As shown in FIG. 4(*a*), the frame 41 is fitted so as to keep a given angle with the pressing plate 20 and can turn together with the pressing plate 20 with maintaining the above angle when it is not in contact with the printing material (printing paper) 1. A spring 15 is provided as a biasing means between the frame 41 and the pressing plate 20. The spring 15 is fitted to the revolving shaft 12 and gives a biasing force to the frame 41 in the direction toward the base stand 10 when the frame 41 comes close to the pressing plate 20 and the angle therebetween becomes smaller than the above angle.

As shown in FIGS. 4(*a*) and (*b*), a projection 45 is provided on the surface of the frame 41 on the side of the pressing plate 20 at the position near the revolving shaft 12. The spring 15 contacts with the frame 41 at the projection 45. As compared with a case where the spring 15 is supposed to directly contact with the surface of the frame 41 on the side of pressing plate 20, when the spring 15 is deformed by pressing the pressing plate 20 onto the side of the base stand 10, deformation of the spring 15 increases in correspondence to the projection 45. Thus, the springing force of the spring 15 increases accordingly, and separability between the frame 41 and the pressing plate 20 at the time of opening the pressing plate 20 after completion of printing is improved. In this way, when the springing force of the spring 15 is increased, the pressing plate 20 can be easily separated from the porous member 4 with the porous member 4 being left onto the printing material 1.

Figure 5:
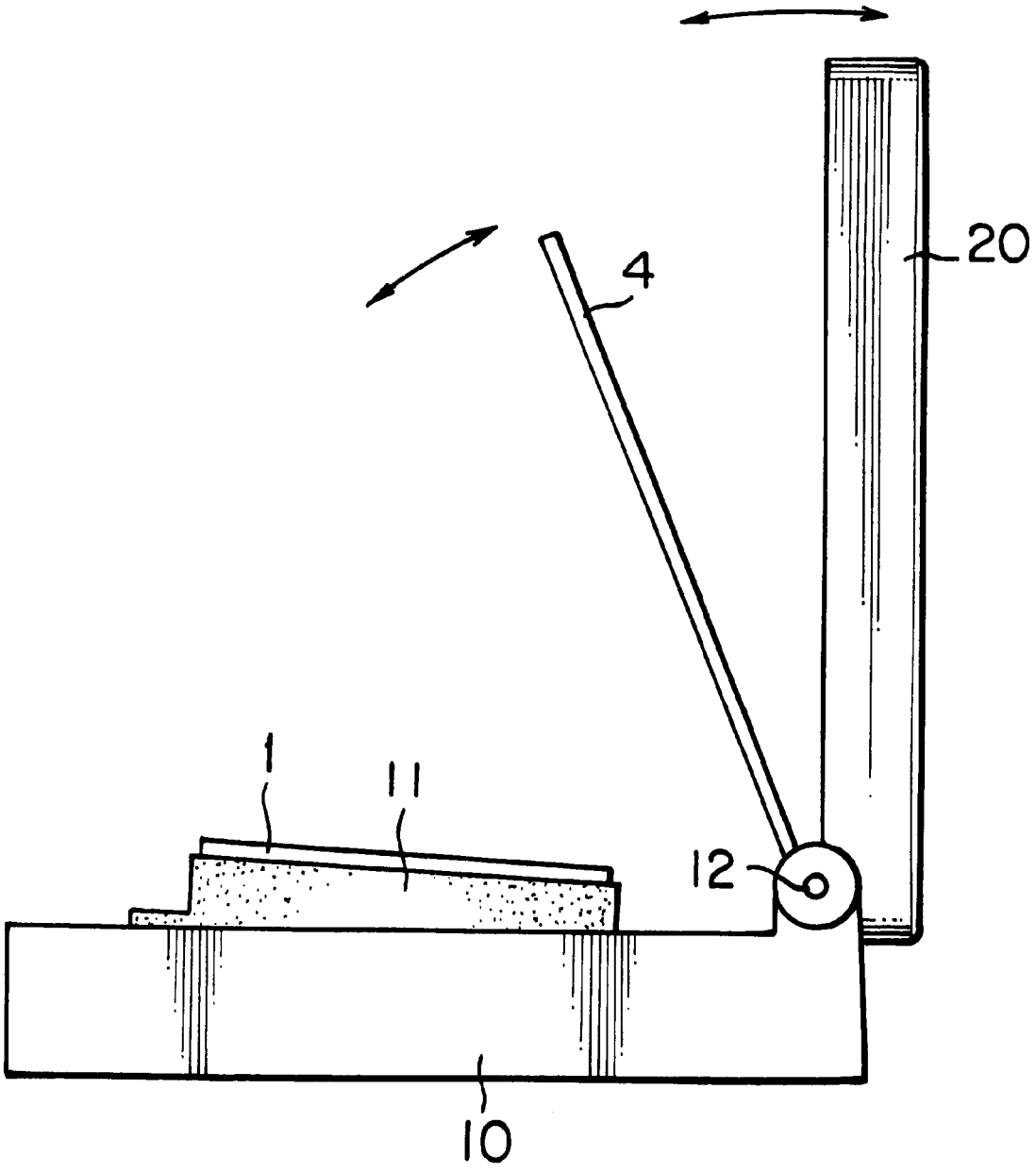
FIG. 5 is a side view which shows an operation of the printing apparatus of FIG. 3.
Figure 6:
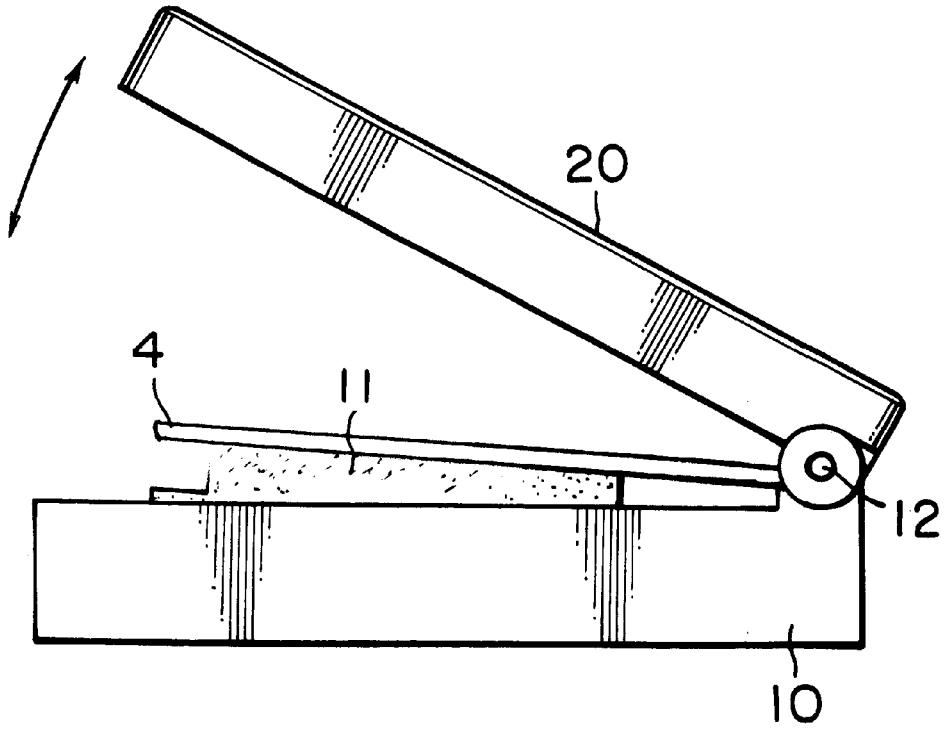
FIG. 6 is a side view which shows an operation of the printing apparatus of FIG. 3.
Figure 7:
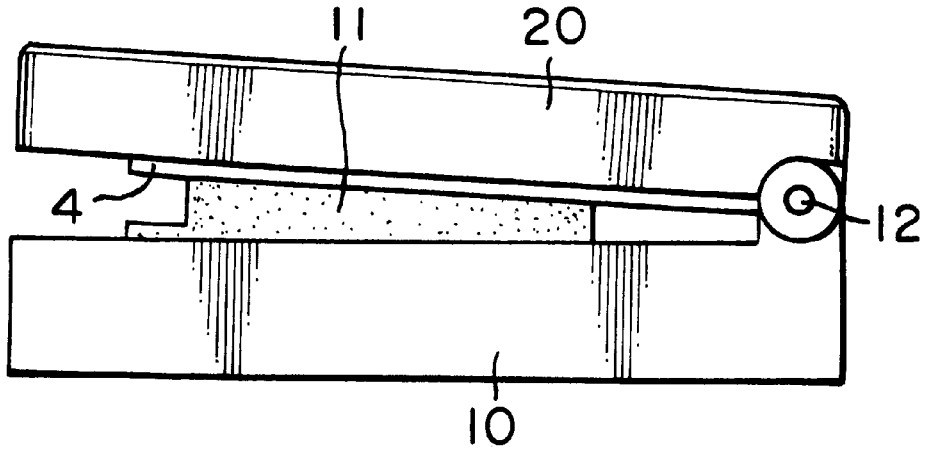
FIG. 7 is a side view which shows an operation of the printing apparatus of FIG. 3

Next, operation of the printing apparatus of the present invention will be explained. Several sheets of printing papers are stacked on the paper stacking stand 11 of the base stand 10. A perforated stencil sheet unit containing an ink is fitted to the fitting part 25 of the pressing plate 20. The porous member 4 is fitted to the printing apparatus. The pressing plate 20 is turned toward the base stand 10. As shown in FIG. 5, when the pressing plate 20 is apart from the base stand 10 at a maximum, the pressing plate 20 forms an angle of about 90° with the base stand 10. In this state, the porous member 4 is positioned at an angle of about 60° with the base stand 10. With turning of the pressing plate 20, the porous member 4 turns with keeping an angle of about 30° with the pressing plate 20. As shown in FIG. 6, after the porous member 4 contacts with the uppermost printing paper put on the base stand 10, the spring 15 deforms and only the pressing plate 20 turns. Furthermore, as shown in FIG. 7, the pressing plate 20 is pressed to the base stand 10, thereby pressing the stencil sheet unit onto the printing paper to carry out printing.

After completion of the printing, the pressing plate 20 is turned up. As shown in FIG. 6, the porous member 4 is held on the printing paper by the pressing force of the spring 15 until the angle between the pressing plate 20 and the base stand 10 reaches about 30°, and, therefore, the porous member 4 is separated from the stencil sheet unit which is an integral article of the master stencil and the ink supply means. When the pressing plate 20 is further turned upward and forms an angle of greater than about 30°, the porous member 4 begins to turn upward together with the pressing plate 20 and is separated from the printing paper. At this time, the surface of the printing ink impregnated in the porous member 4 has already been released from the pressing force of the pressing plate 20 and subjected to atmospheric pressure, and hence irregularities are hardly formed on the surface of the printing ink transferred to the printing paper. As a result, a print high in smoothness is obtained.

In the above example, an apparatus suitable for carrying out the embodiment of FIG. 2(*b*) has been explained, but it is a matter of course that if the frame 41 has a function to hold the stencil sheet unit, the printing apparatuses for carrying out the embodiments of FIG. 1 and FIGS. 2(*a*) and 2(*b*) can be constructed.

According to the present invention, the printing ink is temporarily retained in the porous member and controlled to a uniform thickness under atmospheric pressure in the porous member after having been transferred to a printing material, and then the porous member is separated from the printing material. Therefore, no abrupt change of pressure is applied to the surface of the printing ink transferred to the printing material. Accordingly, even if a printing ink of high viscosity is used, it can be transferred to the printing material at a uniform thickness, and a print less in irregularity on the surface of the ink and high in gloss of the ink can be obtained. Thus, printing of solid portions or printing on a paper low in ink permeability or on a smooth surface of plastics can be performed with giving high quality, and the present invention is especially suitable for printing on coated paper, CD-ROMs, name plates, glass sheets and others.

What is claimed is:

1. A stencil printing method comprising:

providing a pad-like ink supply means having an ink-passing surface, pressing said ink-passing surface of said ink supply means to a printing material to be printed while interposing a master stencil sheet and an ink-passing porous member between said ink-passing surface and said printing material, whereby an ink is transferred from said ink supply means to said printing material through said ink-passing surface in accordance with an image of said master stencil sheet, separating said ink supply means from said porous member while said porous member is left on said printing material, and separating said porous member from said printing material.

2. A stencil printing method according to claim 1, wherein said porous member is disposed between said master stencil sheet and said printing material.

3. A stencil printing method comprising:

providing an ink supply means having an ink-passing surface, pressing said ink-passing surface of said ink supply means to a printing material to be printed while interposing a master stencil sheet and an ink-passing porous member between said ink-passing surface and said printing material, wherein said ink-passing porous member is disposed between said ink supply means and said master stencil sheet, whereby an ink is transferred from said ink supply means to said printing material through said ink-passing surface in accordance with an image of said master stencil sheet, separating said ink supply means from said porous member while said porous member is left on said printing material, and separating said porous member from said printing material.

4. A stencil printing method according to claim 3, wherein said porous member is separated from said printing material together with said master stencil sheet.

5. A stencil printing method comprising:

providing an ink supply means having an ink-passing surface, pressing said ink-passing surface of said ink supply means to a printing material to be printed while interposing a master stencil sheet and an ink-passing porous member between said ink-passing surface and said printing material, wherein said ink-passing porous member is disposed between said master stencil sheet and said printing material, whereby an ink is transferred from said ink supply means to said printing material through said ink-passing surface in accordance with an image of said master stencil sheet, separating said ink supply means from said porous member while said porous member is left on said printing material, and separating said porous member from said printing material together with said master stencil sheet.

6. A stencil printing method comprising:

pressing together an ink supply means and a printing material to be printed while a master stencil sheet and an ink-passing porous member are interposed between said ink supply means and said printing material, whereby an ink is transferred from said ink supply means to said printing material in accordance with an image of said master stencil sheet, wherein said porous member is disposed between said master stencil sheet and said printing material, separating said ink supply means together with said master stencil sheet from said porous member while said porous member is left on said printing material, and separating said porous member from said printing material.

7. A stencil printing method comprising:

providing an ink supply means having an ink-passing surface, pressing said ink-passing surface of said ink supply means to a printing material to be printed while interposing a master stencil sheet and an ink-passing porous member between said ink-passing surface and said printing material, wherein said porous member is arranged coplanar with said master stencil sheet so as to be separable together with said master stencil sheet from said printing material, whereby an ink is transferred from said ink supply means to said printing material through said ink-passing surface in accordance with an image of said master stencil sheet, separating said ink supply means from said porous member while said porous member is left on said printing material, and separating said porous member together with said master stencil sheet from said printing material.

8. A stencil printing apparatus comprising:

a first member which supports a printing material, a second member which supports a pad-like ink supply means having an ink-passing surface and supports a master stencil sheet on said ink-passing surface opposing said printing material so that said ink-passing surface is pressed to said printing material with said master stencil sheet interposed therebetween, and a third member which supports a porous member between the first member and the second member so that said second member is separable from said porous member while said porous member is placed on said printing material.

9. A stencil printing apparatus which comprises a first member which supports a printing material, a second member which is disposed opposing the first member to press said printing material and supports an ink supply means on a surface opposing said printing material, and a third member which supports a master stencil sheet and a porous member one upon another between the first member and the second member, the third member being biased toward the first member so that the second member can be separated from the third member while the third member is placed on the first member.

* * * * *